US007320816B2

(12) United States Patent
Quigel

(10) Patent No.: US 7,320,816 B2
(45) **Date of Patent: *Jan. 22, 2008**

(54) COLLAPSIBLE DECORATIVE STRUCTURE

(76) Inventor: Cameron F. Quigel, 9769 E. Hwy. 26, Stockton, CA (US) 95215

( * ) Notice: Subject to any disclaimer, the term of this patent is extended or adjusted under 35 U.S.C. 154(b) by 360 days.

This patent is subject to a terminal disclaimer.

(21) Appl. No.: 10/736,233

(22) Filed: Dec. 15, 2003

(65) Prior Publication Data

US 2004/0185189 A1 Sep. 23, 2004

Related U.S. Application Data

(63) Continuation-in-part of application No. 10/251,250, filed on Sep. 20, 2002, now Pat. No. 6,663,921.

(51) Int. Cl.
*A47G 33/04* (2006.01)
*A47G 33/06* (2006.01)

(52) U.S. Cl. ..... 428/18; 428/7; 428/9; 428/12; 428/19; 428/20; 428/17; 428/542.2

(58) Field of Classification Search ..... None
See application file for complete search history.

(56) References Cited

U.S. PATENT DOCUMENTS 1,976,093 A * 10/1934 Raymond ..... 428/28
3,723,723 A * 3/1973 Lerner ..... 362/251
4,011,674 A * 3/1977 Jacobson ..... 40/426
4,620,270 A * 10/1986 Laakso ..... 362/123
6,162,515 A * 12/2000 Hill ..... 428/20
6,663,921 B1 * 12/2003 Quigel ..... 428/12

* cited by examiner

*Primary Examiner*—G. Blackwell
(74) *Attorney, Agent, or Firm*—Henneman & Associates, PLC; Larry E. Henneman, Jr.

(57) ABSTRACT

A novel decorative structure includes a length of strand material, having a plurality of individual strands twisted with respect to one another and fixed with respect to one another near a first end of the strands, a twisting member having a plurality of apertures formed therein, each adapted to receive a respective one of the individual strands therethrough, and an anchoring member adapted to support the decorative structure on a support surface. In a particular embodiment the twisting member is a disc, such that when the twisting member is advanced from a second end of the strands to the first end, the strand material is caused to unwind. Similarly, when the twisting member is advanced from the first end to the second end of the strands, the strand material is caused to wind up. When unwound, the strands can support a container within the unwound ends of the strand material.

29 Claims, 5 Drawing Sheets

FIG. 2
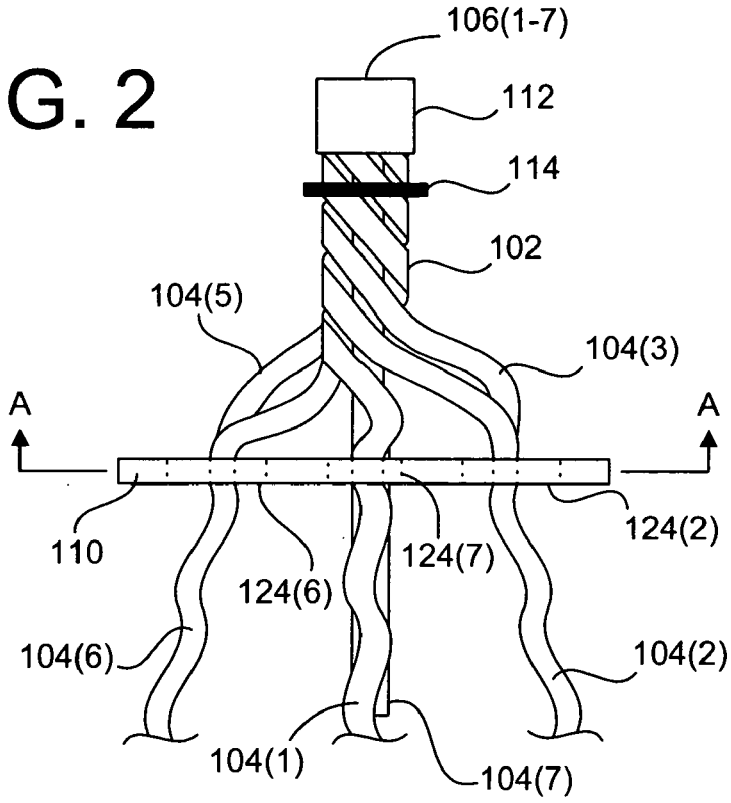
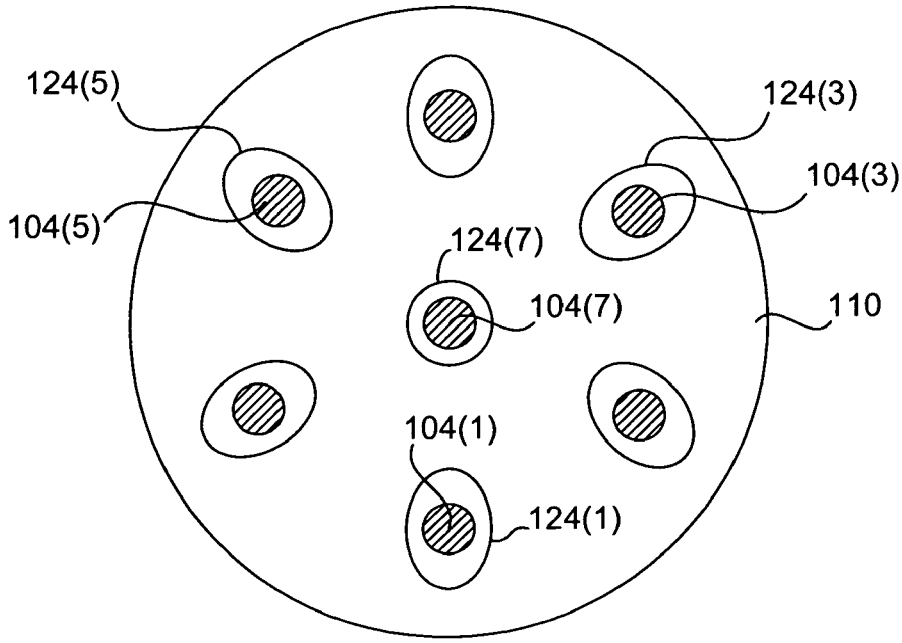
FIG. 3

COLLAPSIBLE DECORATIVE STRUCTURE

RELATED APPLICATIONS

This application is a continuation-in-part of prior U.S. patent application Ser. No. 10/251,250 filed on Sep. 20, 2002 by the same inventor, which issued Dec. 16, 2003 as U.S. Pat. No. 6,663,921, and which is incorporated herein by reference.

BACKGROUND OF THE INVENTION

1. Field of the Invention

This invention relates generally to decorative and support structures, and more particularly to a collapsible Christmas tree and support structure that are easy to erect, easy to collapse, compact for storage, and whose structures have a decorative shape and can support additional items when erected, in either an upright or inverted position.

2. Description of the Background Art

During the holiday seasons, homes are commonly adorned in and out with festive decorations. One common decoration is the artificial Christmas tree.

Artificial trees are designed and manufactured in both indoor and outdoor varieties. Indoor and outdoor type artificial trees each suffer several disadvantages. Indoor trees, for example, require large amounts of storage space because they are generally formed from many interconnecting components that have fragile branches and pine needles attached thereto for decoration. Additionally, the components, because of their interconnecting complexities, require a substantial amount of time to setup.

One type of outdoor artificial tree is essentially a conical wire frame structure, to which decorations can be attached. The wires used in such frames is typically straight, and so the frame structures are generally plain, and apart from their conical shape and attached decorations bear little resemblance to a real tree. Further, the wire frame structures are typically formed as a single unit, and therefore require a relatively large amount of storage space when not being displayed.

Also, whether during the holidays or other times of the year, structures are used in the garden and other areas of the home to support plants or other items (e.g., ivy, garland, pots containing plants, serving bowls, containers etc.). Like decorations, such support structures typically require disassembly and/or occupy significant storage space when not in use. It would be beneficial, therefore, to have a structure capable of supporting various items that is easy to erect and collapse, that has a decorative appearance, and that requires a relatively small amount of storage space.

What is needed, therefore, is a decorative structure that is suitable for indoor and outdoor use, that requires little assembly or disassembly, is compact and easy to store, and has a structure with a decorative shape suggestive of a Christmas tree. What is also needed is a structure that can support a container or other item when erected.

SUMMARY

The present invention overcomes the problems associated with the prior art by providing a decorative structure that is easy to erect and to collapse, is compact for storage, and whose structure has a decorative shape suggestive of a Christmas tree. The present invention also overcomes the problems associated with the prior art by providing a structure that can support an object off the ground when erected.

The decorative structure includes a length of strand material and a twisting member. The strand material includes a plurality of individual strands that are twisted with respect to one another, and are fixed with respect to one another near first ends of the strands. The twisting member includes a plurality of apertures formed therein, each adapted to receive a respective one of the individual strands therethrough. In a particular embodiment, the decorative structure resembles a Christmas tree, and the twisting member is a disc defining a separate aperture for each strand of the strand material. In a more particular embodiment, at least one of the apertures is oblong in shape.

To open the tree the twisting member is advanced from a position near second ends of the strands toward the first ends of the strands, causing the strand material to unwind. When unwound, the strands retain a decorative helical shape, suggestive of the layered branches of a Christmas tree. To collapse the tree, the twisting member is advanced from a position near the first ends of the strands toward the second ends of the strands, causing the strand material to wind up.

In a particular embodiment, the decorative structure includes a coupling device disposed near the first end of the strands for fixing the strands together with respect to one another. In a more particular embodiment, the strand material is strand steel, and the coupling device is a weld. In still a more particular embodiment, the strand steel includes a straight center strand which is cut substantially shorter than the remaining strands of the strand material.

Optionally, the decorative structure includes a cover (e.g., a metal cap) for covering the first ends of the strands. In a particular embodiment, the cover is adapted such that a decorative object can be mounted thereto.

An optional strand retainer holds the strands in a wound state. Examples of strand retainers include, but are not limited to, an annular ring having and inner diameter slightly larger than the outer diameter of the wound strands, and/or a removable strap that can be wrapped around the wound strands.

An optional twisting member retainer prevents the strands from disengaging the twisting member. Possible twisting member retainers include, but are not limited to, a separate device (e.g., a grommet, a clamp, removable feet, etc.) coupled to at least one of the strands of the strand material, and/or a deformation (e.g., a bend, an enlargement) in at least one of the strands of the strand material.

Coating the individual strands, while not essential, protects the decorative structure, enhances the decorative appearance, and makes it easier to wind and unwind the strand material. In a particular embodiment, the coating is a white powder coating. Alternatively, the strands can be painted.

Attachment devices are provided for attaching decorations (e.g., Christmas lights, ornaments, etc.) to the decorative structure. In a particular embodiment, the attachment device is a detachable clip having a first end for attaching to one of the individual strands and a second end for attaching to the decoration. The attachment devices, as well as other aspects of the invention even if not explicitly stated, are not considered to be an essential element of the present invention. For example, the decorative structure of the present invention can be used with a decorative slip-over cover, thereby eliminating the need for attachment devices.

In another particular embodiment, the decorative structure includes a plurality of helical strands, each strand having a first end and a second end, a coupling device fixing the strands together near the first ends of the strands, and a positioning device adapted to selectively position the second ends of the strands a spaced distance from one another. The positioning device is further adapted to selectively position the second ends of the strands in a close together relationship, for example for storage.

In still another particular embodiment, the decorative structure includes an anchoring member disposed near the first end of the strand material. The anchoring member is adapted to support the decorative structure on a support surface. In addition, the structure is adapted to support a container or other object within the strands when erected. In a particular embodiment, the anchoring member is conically shaped such that it can be pressed into the ground with the second ends of the strands above the first ends. Optionally, the decorative structure includes a press plate to assist in pressing the anchoring member into the support surface.

A method for erecting a decorative structure is also described. The method includes the steps of providing a length of strand material including a plurality of individual strands twisted with respect to one another, and fixed together at a first end with respect to one another. The method further includes unwinding the strands of the strand material from a second end to the first end using a twisting member. The twisting member defines a plurality of apertures, each aperture adapted to receive a respective one of the individual strands therethrough. The method of erecting a decorative structure further includes an optional step of releasing a strand retainer, either prior to or during the step of unwinding the strands. In a particular method, the step of unwinding the strands includes twisting the twisting member about a longitudinal axis oriented generally inline with the strand material. In yet another particular method, the method of erecting a decorative structure includes standing the decorative structure upright, such that the decorative structure is supported by the unwound ends of the strands.

A more particular method for erecting a decorative structure further includes rewinding the strands of the strand material by moving a twisting member from the first end of the strand material toward the second end of the strand material, while rotating said twisting member about a longitudinal axis of said strand material. Optionally, the method further includes the step of applying a retainer near the second end of said strand material to prevent the unwinding of the strands.

Another particular method for erecting a decorative structure includes anchoring the decorative structure to a support surface using an anchoring member. In a more particular method, the anchoring member is conical and disposed near the first end of the strand material such that the anchoring member can be pressed into the ground.

A method for manufacturing a decorative structure is also disclosed. The method includes the steps of providing a length of strand material including a plurality of individual strands twisted with respect to one another, coupling the strands with respect to one another near a first end of the strand material, providing a twisting member having a plurality of apertures formed therein, and positioning a second end of each of the individual strands in a respective one of the apertures of the twisting member.

The method of manufacturing the decorative structure further includes an optional step of providing a cover for covering the first end of the strands, an optional step of providing a strand retainer for retaining the strands in a wound state, and an optional step of providing a twisting member retainer for retaining at least one individual strand in a respective aperture of the twisting member.

A particular method of manufacturing the decorative/support structure further includes the steps of providing an anchoring member, and coupling the anchoring member near the first ends of the strands of the strand material. A more particular method of manufacturing the decorative structure includes providing a container adapted to engage the decorative structure near the second ends of the strands. Another more particular manufacturing method includes the step of providing a conical anchoring member, having an optional press plate.

BRIEF DESCRIPTION OF THE DRAWINGS

The present invention is described with reference to the following drawings, wherein like reference numbers denote substantially similar elements:

FIG. 2 is a front plan view of a first end of the decorative structure of FIG. 1;

FIG. 3 is a cross-sectional view taken along section line A-A through the twisting member of FIG. 2;

DETAILED DESCRIPTION

The present invention overcomes the problems associated with the prior art, by providing a collapsible decorative structure (e.g., a Christmas tree) that is compact and easy to store, requires little assembly or disassembly, and has a structure that retains a decorative appearance when erected. In the following description, numerous specific details are set forth (e.g., number of individual strands in strand material, use of steel strand material, etc.) in order to provide a thorough understanding of the invention. Those skilled in the art will recognize, however, that the invention may be practiced apart from these specific details. In other instances, details of well known processes (e.g. strand material fabrication, powder coating, etc.) have been omitted, so as not to unnecessarily obscure the present invention.

Figure 1:
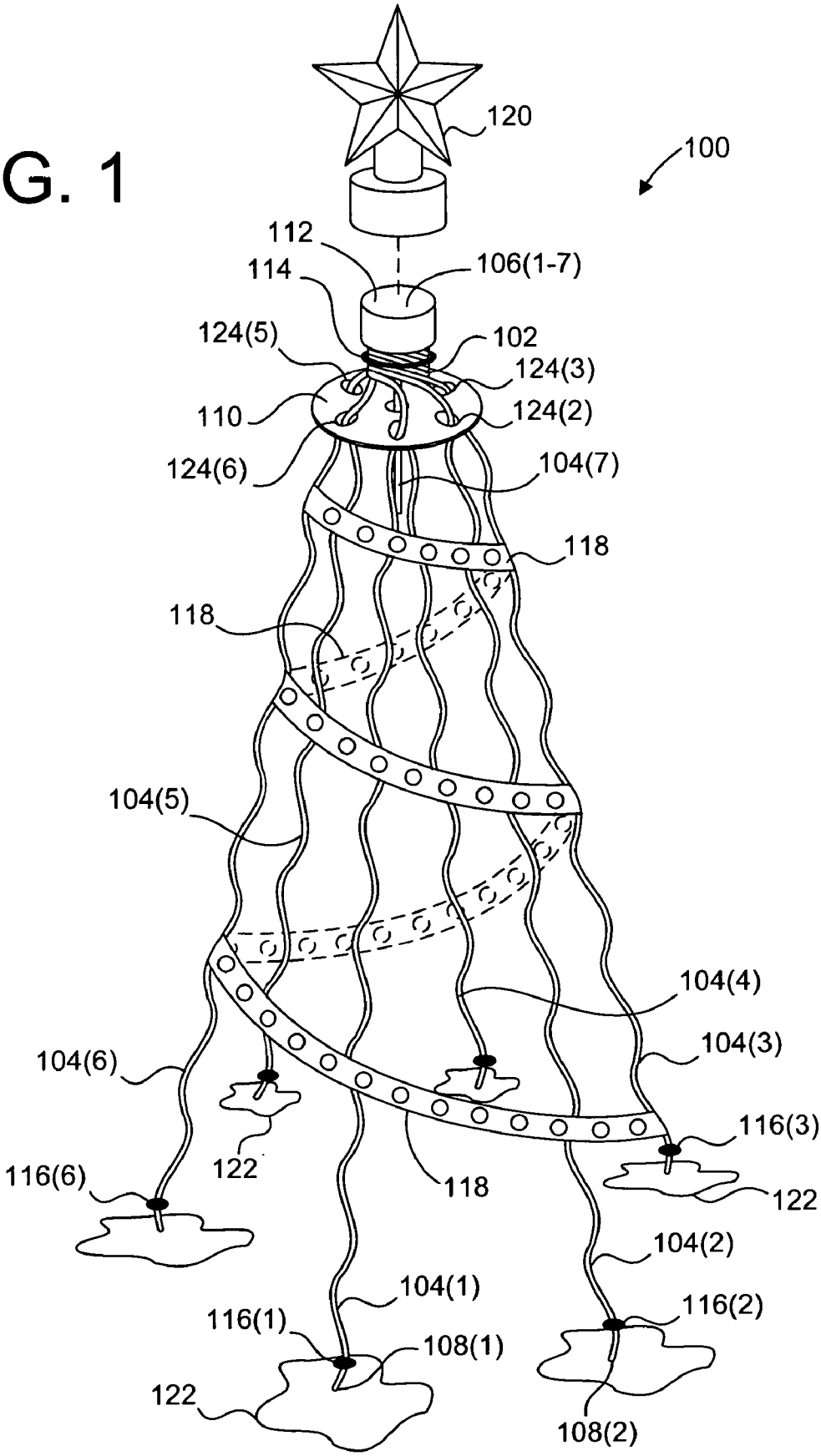
FIG. 1 is a perspective view showing an embodiment of a decorative structure of the present invention in a display state.

FIG. 1 shows a decorative structure 100 according to one embodiment of the present invention. Decorative structure 100 includes a length of strand material 102, that is composed of a plurality of individual strands 104(1-7), each having a first end 106(1-7) and a second end 108(1-7). Decorative structure 100 further includes a twisting member 110, an end cover 112, a strand retainer 114, and a plurality of twisting member retainers 116(1-6). In addition, decorative structure 100 includes a decoration 118 draped around strands 104(1-6), and a decorative cap 120 adapted to mount over end cover 112.

In the erected state shown in FIG. 1, decorative structure 100 is supported on a support surface 122 by the second ends 108(1-6) of strands 104(1-6). Individual strands 104(1-6) are fixed in position with respect to each other at their first ends 106(1-7), which are wound around straight center strand 104(7). Twisting member 110 defines a plurality of apertures 124(1-7), through each of which a respective one of strands 104(1-7) passes. When twisting member 110 is positioned near first ends 106(1-7) of strands 104(1-7), second ends 108(1-7) are positioned in a spaced apart relationship by twisting member 110. As twisting member 110 is moved toward second ends 108(1-7), as will be described in greater detail hereinafter, second ends 108(1-7) are drawn into a close together relationship. Thus, twisting member 110 functions as a positioning device that selectively positions second ends 108(1-7) in either a spaced apart relationship (erected state) or a close together relationship (collapsed state).

Cover 112 is a metal cap that covers first ends 106(1-7) of strands 104(1-7) for safety and aesthetics. Strand retainer 114 keeps strands 104(1-7) in a wound relationship when decorative structure 100 is in the collapsed state, as will be described below. In this particular embodiment, strand retainer 114 is an annular ring having an inner diameter slightly larger than the outer diameter of strand material 102 in its wound state. Decoration 118 represents Christmas lights, garland, and the like which can be draped around or fastened to decorative structure 100. Decorative cap 120 is adapted to detachably mount over cover 112, to facilitate the use of a variety such decorations. Optionally, decorative cap 120 and cover 112 can be formed integrally to reduce the number of parts.

In the present embodiment, decorative structure 100 is a Christmas tree, and will hereinafter be referred to as such. It should be noted, however, that the decorative structure described herein can be used for other occasions or purposes (e.g., theater scenery, landscape decorations, etc.), in addition to the Christmas tree embodiment shown.

Also in the present embodiment, strand material 102 is formed from 0.6" strand steel having six twisted strands (e.g., strands 104(1-6)) and a straight center strand (e.g., strand 104(7)). Manufacturing Christmas tree 100 from strand steel is inexpensive because strand steel is readily available in industry (e.g., in concrete reinforcement), as well as, provides durability to tree 100. Additionally, Christmas tree 100 can be manufactured from scrap pieces (e.g. a few feet long) which are of little or no value for conventional strand steel applications. It should also be noted that alternate materials may be used to manufacture tree 100 including, but not limited to, molded plastics, other metals, wood, and/or fiber products.

The present invention provides several advantages over the prior art. One advantage is that Christmas tree 100 can be quickly and easily erected and collapsed. Twisting member 110 facilitates the winding and unwinding of strand material 102. When twisting member 110 is advanced from a position near first ends 106(1-7) to a position near second ends 108(1-7) of strands 104(1-7), and twisting member 110 is simultaneously rotated about a longitudinal axis of the strand material, the individual strands 104(1-6) of strand material 102 are caused to wind up into a twisted relationship. Conversely, advancing twisting member 110 from second ends 108(1-7) to first ends 106(1-7) of strands 104(1-7) causes strands 104(1-7) to unwind into the open relationship depicted in FIG. 1.

It should be noted that twisting member 110 is not an essential element of the present invention. For example, an alternate tree can be formed, without a twisting member, from a plurality of helical (or otherwise wavy) strands fixed together near their first ends by a coupling device (e.g., a weld, clamp, etc.). A simple solid structure (e.g., a cone, a pyramid, a sphere, etc.) placed between the helical strands would serve as a positioning device to hold the second ends of the strands in a spaced apart relationship, instead of the twisting member. Thus, to erect the alternative tree, the user would simply wedge the positioning device up between the strands near enough to the fixed first ends to obtain the desired spacing of the second ends. Similarly, to collapse the alternate tree, the user need only remove the positioning device. Because this embodiment does not include a twisting member, the helical strands could not be wound and unwound, but would merely be gathered together for storage. Optionally, the positioning device can be mounted to or supported by a center strand. As another option, the positioning device can include grooves for receiving and positioning the individual strands.

In its wound state, tree 100 can be easily transported and stored. As previously described, prior art artificial trees require substantial storage space. Tree 100, when in its wound state, is not significantly larger than the strand steel cable from which it is formed (see FIG. 4). Therefore, tree 100 requires significantly less storage space than conventional artificial Christmas trees.

Another advantage provided by tree 100 is that strands 104(1-6) retain their twisted shape when unwound. The helical shape of strands 104(1-6) provide a wavy appearance suggestive of the boughs of a pine tree. This is a significant improvement over the straight wire frame structures of the prior art.

Strands 104(1-7) are individually coated for appearance and protection. The inventor has determined that strands 104(1-7) can be easily powder coated when tree 100 is in its erect state. Powder coating strands 104(1-7) adds a durable, colorful finish, and provides rust protection. Optionally, strands 104(1-7) can be individually painted to obtain similar benefits.

Strands 104(1-7) can be powder coated or painted in a variety of colors depending on intended use and individual preference. For example, tree 100 is powder coated white to suggest a snow covered Christmas tree. As another example, tree 100 could be painted green, suggestive of an evergreen tree. Obviously, if tree 100 was formed from a plastic, the plastic could be colored to give the tree a colored appearance.

To summarize, Christmas tree 100 can be wound up for storage as follows. First, decoration 118 is removed from cap 112. Next, individual strands 104(1-6) are wound together by advancing twisting member 110 toward free second ends 108(1-7)) of strands 104(1-6). As twisting member 110 is advanced along the length of strand material 102, twisting member 110 is twisted about the longitudinal axis of strand material 102. Twisting member retainers 116(1-6) prevent twisting member 110 from coming off of second ends 108(1-6) of strands 104(1-6). Finally, strands 104(1-6) are secured in their twisted state by sliding strand retainer 114 from first ends 106(1-7) to a position near second ends 108(1-6) of strands 104(1-6) to prevent the unraveling strands 104(1-6).

From its wound state, tree 100 is erected as follows. First, strand retainer 114 is released by moving strand retainer 114 from second ends 108(1-6) to a position near first ends 106(1-7) of strands 104(1-7). Next, advancing twisting member 110 toward first ends 106(1-7) of strands 104(1-7) causes strand material 102 to unwind. When twisting member 110 reaches a position near first ends 106(1-7) of strands 104(1-7), second ends 108(1-6) of strands 104(1-6) are held in an open, spaced apart relationship, such that second ends 108 of strands 104(1-6) can support tree 100 on ground 122. Finally, tree 100 can be decorated by fastening (e.g. with attachment device 500, clips, hooks, etc.) decoration 118 to strands 104(1-7), and by placing decorative cap 120 over cover 112.

FIG. 2 is a front plan view of a portion of collapsible tree 100 near first ends 106(1-7). There are several notable features of tree 100, which are clearly shown in FIG. 2. First, center strand 104(7) is shown straight and cut substantially shorter than the remaining individual strands 104(1-6) because of its non-helical shape. Additionally, individual strands 104(1-6) are twisted around center strand 104(7) near first ends 106(1-7). Retaining at least a portion of center strand 104(7) is beneficial to retain proper position and winding of helical strands 104(1-6). Finally, in the present view twisting member 110 is shown as a flat disc, having each of strands 104(1-7) passing therethrough, and is centered about a longitudinal axis of strand material 102 passing through center strand 104(7).

FIG. 3 is a cross-sectional view taken along section line A-A of FIG. 2 showing twisting member 110 in greater detail. In the present embodiment, twisting member 110 is formed (e.g., machined, molded, etc.) from plastic, but it should be understood that alternate materials including, but not limited to, metal, fiberglass, wood, etc. may be used. Twisting member 110 is a round disc, having apertures 124(1-6) situated around the perimeter and aperture 124(7) located in the center. Apertures 124(1-6) are oblong to facilitate easier winding and unwinding of strands 104(1-6), which vary in separation from center as they travel through their respective apertures 124(1-6) when twisting member 110 is advanced along strand material 102. Center aperture 124(7) is circular because center strand 104(7) is straight. Optionally, twisting member 110 can be manufactured with finger grooves (not shown) about the perimeter, to make twisting member easier to grip.

Figure 4:
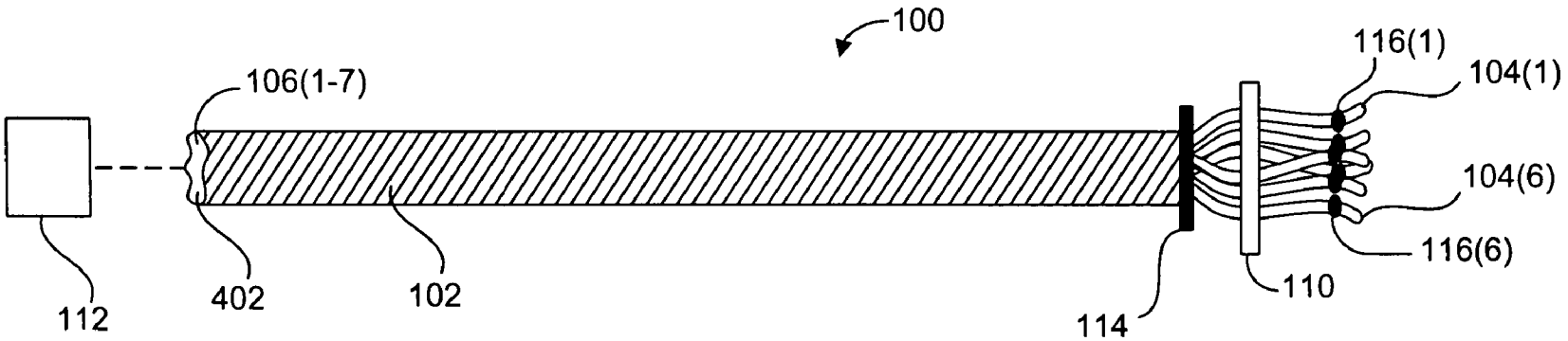
FIG. 4 is a partially exploded view showing the decorative structure of FIG. 1 in a storage state.

FIG. 4 shows a partially exploded view of Christmas tree 100, in its wound up, collapsed state. Cover 112 is removed from first ends 106(1-7) to expose a weld 402. Weld 402 mechanically couples strands 104(1-7) together at first ends 106(1-7). Weld 402 is most easily formed during manufacture using an oxy-acetylene torch, wherein the strand material 102 is melted, but could be formed with alternate methods including, but not limited to, stick, MIG, and TIG welds, or brazing. Alternately, strands 104(1-7) can be fixed together using a clamp or strap secured around first ends 106(1-7), and/or a suitable epoxy.

Substitutions for other components of tree 100 can also be made without departing from the scope of the invention. For example, a deformation (e.g., a bend, extrusion, melted portion, etc.) in at least one of strands 104(1-6) to retain twisting member 110 on strands 104(1-7) could be substituted for twisting member retainers 116(1-6). In a particular embodiment, the deformation is a loop is formed near the second end(s) of one or more strands 104(1-6) to facilitate anchoring tree 100 to the ground thereby, for example using stake(s). As another example, a strap wrapped around strands 104(1-6) near second ends 108(1-7) could be substituted for strand retainer 114.

Figure 5:
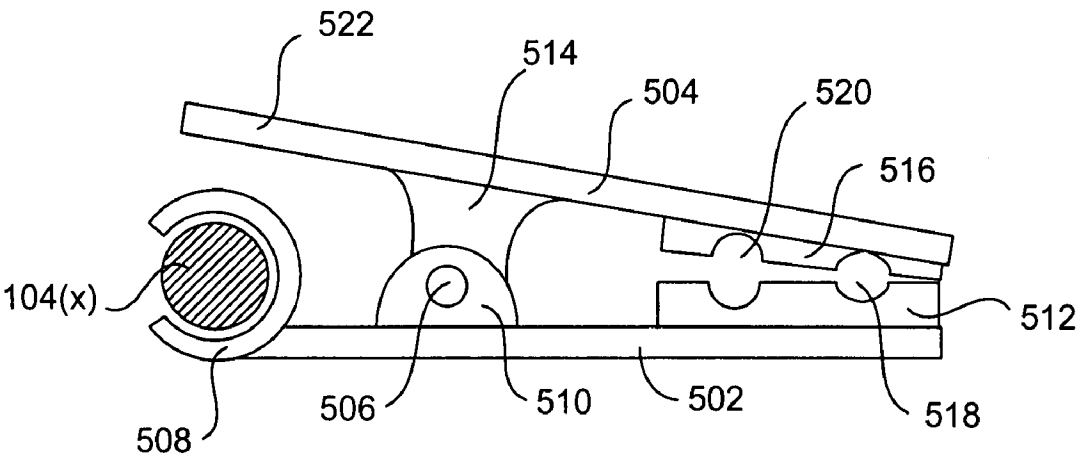
FIG. 5 is a top plan view of a fastening clip for fastening decorations to the decorative structure of FIG. 1.

FIG. 5 shows a top view of an attachment device 500 for attaching decorations (e.g., decoration 118) to tree 100. Attachment device 500 includes a lower jaw 502 and an upper jaw 504 coupled to lower jaw 502 by a pin 506. Lower jaw 502 includes a strand clamp 508, a lower pin support 510, and a lower tooth 512. Similarly, upper jaw 504 includes an upper pin support 514 and an upper tooth 514. Lower tooth 512 and upper tooth 514, when together, define a small guideway 518 and a large guideway 520 for grasping decorations of various sizes. Compression is placed on lower tooth 512 and upper tooth 514 by a spring (not shown) acting about pin 506 on lower jaw 502 and upper jaw 504.

In the current view, attachment device 500 is a detachable clip and can selectively engage one of individual strands 104(*x*) when tree 100 is erected by pressing strand clamp 508 onto strand 104(*x*). Lower pin support 510 engages upper pin support 514 at pin 506. When attached to tree 100, upper jaw 504 is pivotal about pin 506, permitting upper tooth 516 to separate from lower tooth 512 when force is applied to a pressure end 522 of clip 500. With upper jaw 504 in an open position, decorations can be retained in small guideway 518 or large guideway 520, when upper jaw 504 is released. The number of clips required depends on various factors such as the size of the tree, the character of the decorations, the environment, etc.

Figure 6:
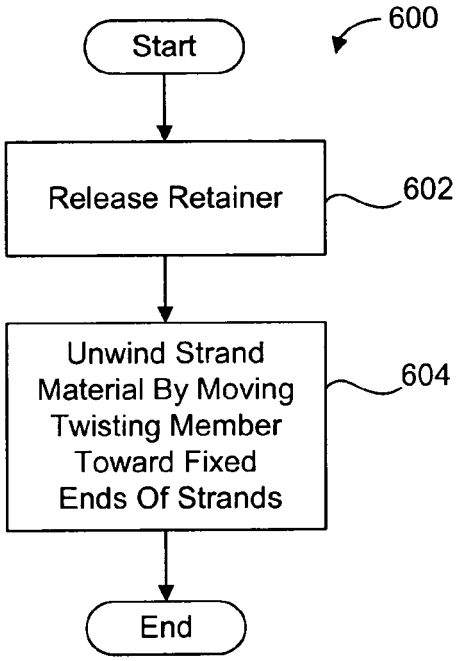
FIG. 6 is a flowchart summarizing one method of erecting the decorative structure of FIG. 1.

FIG. 6 is a flowchart summarizing one method 600 of erecting decorative structure 100 according to the present invention. In a first step 602, strands 104(1-6) are released by moving strand retainer 114 toward first ends 106(1-7) of strands 104(1-7). Then, in a second step 604, strands 104 (1-6) are unwound by advancing twisting member 110 toward first ends 106(1-7) of strands 104(1-6). Note that strand retainer 114 can be moved either before or as twisting member 110 is advanced.

Figure 7:
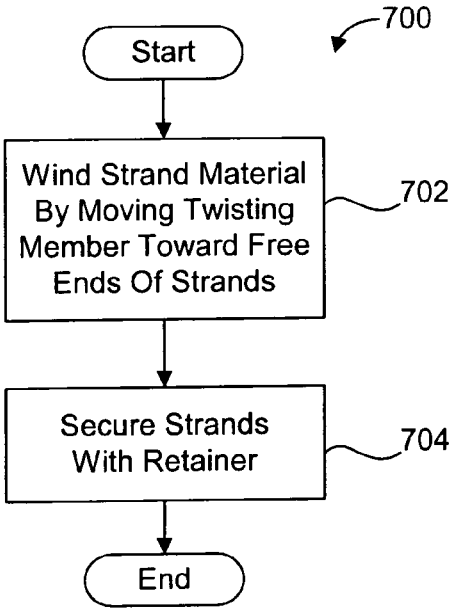
FIG. 7 is a flowchart summarizing one method of collapsing the decorative structure of FIG. 1.

FIG. 7 is a flowchart summarizing one method 700 of collapsing decorative structure 100 according to the present invention. In a first step 702 strands 104(1-6) are wound up by advancing twisting member 110 toward the free ends 108(1-6) of strands 104(1-6). Next, in a second step 704, strands 104(1-6) are secured with strand retainer 114 to prevent unraveling, by sliding strand retainer 114 from a position near first ends 106(1-7) to a position near second ends 108(1-6).

Figure 8:
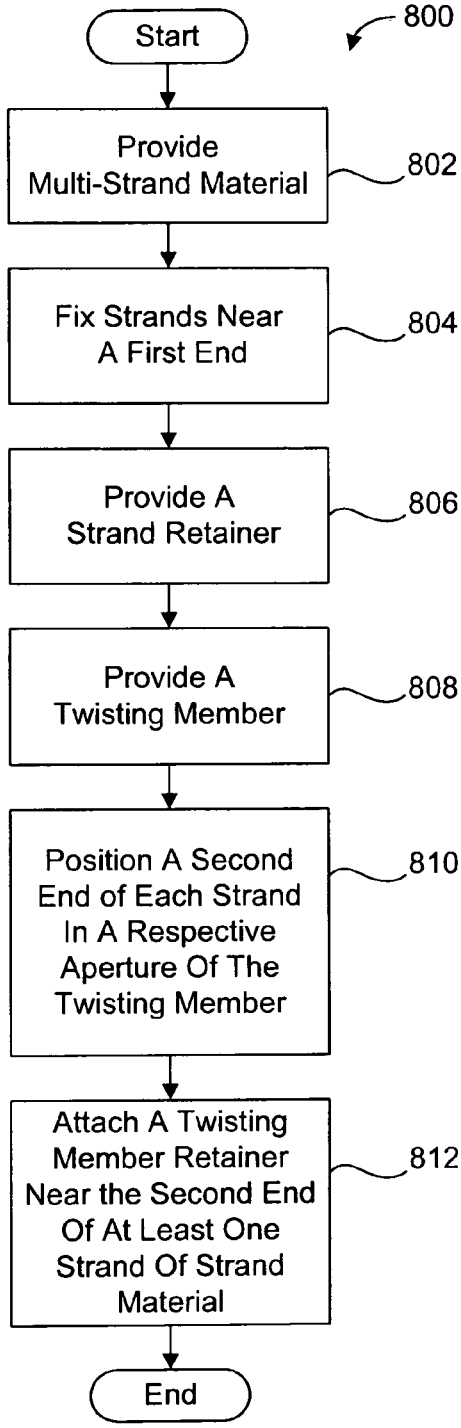
FIG. 8 is a flowchart summarizing one method of manufacturing the decorative structure of FIG. 1.

FIG. 8 is a flowchart summarizing one method 800 of manufacturing decorative structure 100 according to the present invention. In a first step 802, a length of strand material (e.g., strand steel) is provided. Then in a second step 804, strands 104(1-7) are fixed together (e.g., welded, clamped, strapped, etc.) near first ends 106(1-7). Next, in a third step 806, strand retainer 114 is provided, and slid over second ends 108(1-7) of strands 104(1-7) to prevent individual strands 104(1-7) from unraveling. Then, in a fourth step 808, twisting member 110 is provided for winding and unwinding strands 104(1-6) of strand material 102, and in a fifth step 810, second ends 108(1-7) of strands 104(1-7) are positioned in respective apertures 124(1-7) of twisting member 110. Finally, in a sixth step 812, at least one of twisting member retainers 116(1-6) are attached near second ends 108(1-6) of strands 104(1-6) to retain twisting member 110 on strands 104(1-6).

Figure 9:
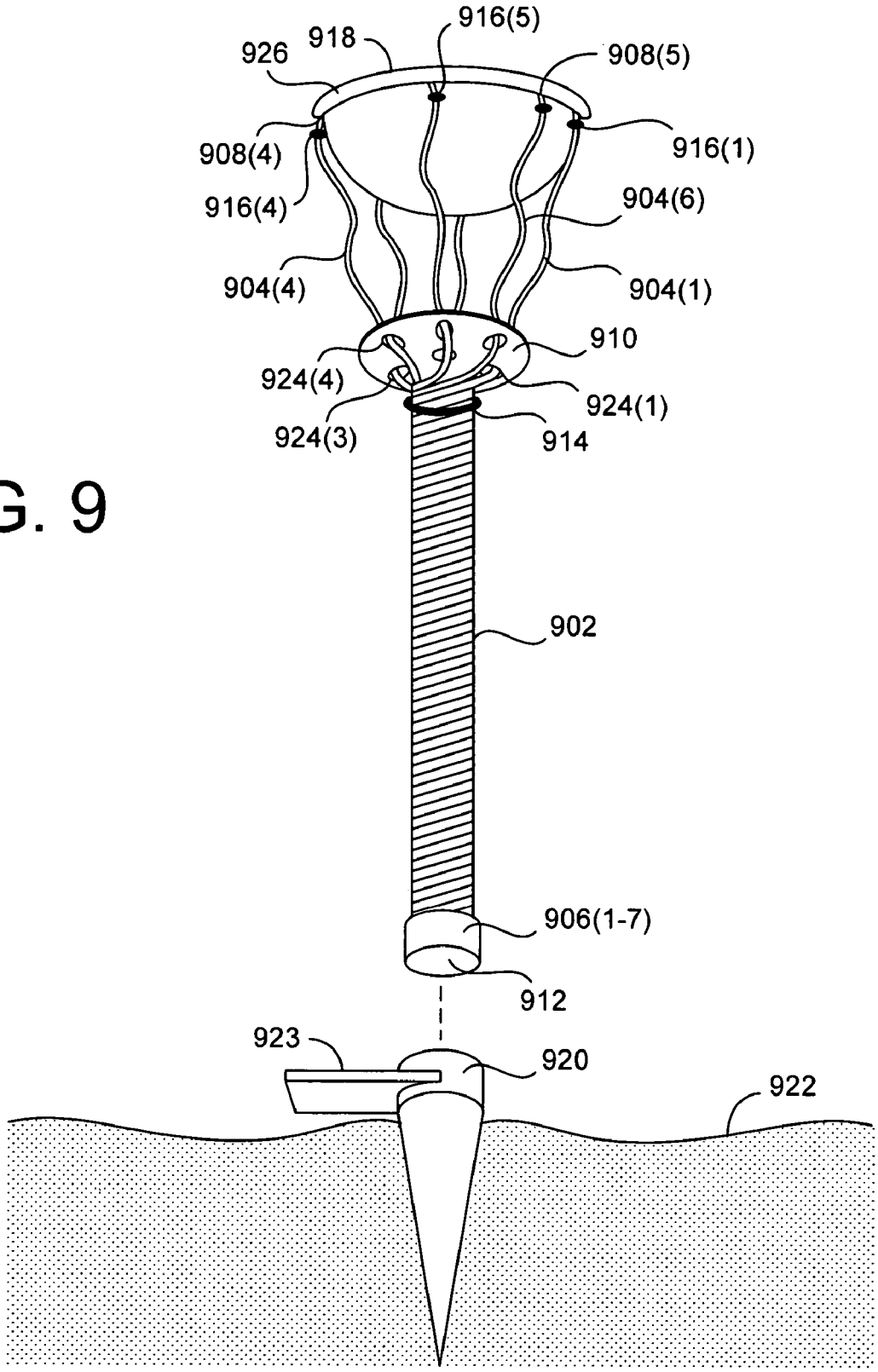
FIG. 9 is a perspective view showing an alternate embodiment of a decorative structure of the present invention supporting a container.

FIG. 9 shows a perspective view of a decorative structure 900 according to an alternate embodiment of the present invention. Decorative structure 900 includes a length of strand material 902, that is composed of a plurality of individual strands 904(1-7) (strand 904(7) is shortened similar to strand 104(7) of FIG. 1 and is not shown), each having a first end 906(1-7) and a second end 908(1-7). Decorative structure 900 further includes a twisting member 910, an end cover 912 (hiding first ends 906 (1-7)), a strand retainer 914, and a plurality of twisting member retainers 916(1-6). Strand material 902, individual strands 904(1-7), twisting member 910, cover 912, strand retainer 914, and twisting member retainers 916(1-6) are each substantially similar to strand material 102, strands 104(1-7), twisting member 110, cover 112, strand retainer 114, and twisting member retainers 116(1-6), respectively, as discussed above with reference to FIG. 1.

In addition, decorative structure 900 includes a container 918 supported by the second ends 908(1-6) of strands 904(1-6), and an anchoring member 920 adapted to mount over end cover 912. Anchoring member 920 is conically shaped such that it can be easily pressed into a support surface 922 (e.g., the ground). Anchoring member 920 also includes a press plate 923 that acts as a pressure surface to facilitate pressing anchoring member 920 into ground 922. Although anchoring member 920 is shown detachable from cover 912, anchoring member 920 can be permanently fixed (e.g., welded, glued, etc.) to cover 912 or to the first ends 906(1-7) of strands 904(1-7).

In the erected state shown in FIG. 9, decorative structure 900 is supported in ground 922 by anchoring member 920, such that decorative structure 900 stands generally upright where the second ends 908(1-6) of strands 904(1-6) are above first ends 906(1-7). Similar to decorative structure 100 of FIG. 1 individual strands 904(1-6) are fixed in position with respect to each other at their first ends 906(1-7), and are wound around a straight center strand (not shown in FIG. 9), which can be cut to some convenient shorter length. Twisting member 910 defines a plurality of apertures 924(1-7), through each of which a respective one of strands 904(1-7) passes. When twisting member 910 is advanced toward the first ends 906(1-7) of strands 904(1-7) as shown, strands 904(1-7) are caused to unwind. In addition, when container 918 is removed, twisting member 910 can be advanced toward second ends 908(1-6) of strands 904(1-06) in order to wind strands 904(1-6) together into a collapsed relationship.

Twisting member 910 is advanced only approximately ¼ the distance between second ends 908(1-6) and first ends 906(1-7) of strands 904(1-7) in order to retain the rigidity of decorative structure 900. Retaining the majority of the length of strands 904(1-6) in a wound state permits decorative structure 900 to stand generally upright when erected and to support the weight of container 918 without strands 904(1-6) bending excessively. It should also be noted that twisting member retainer 914 is positioned near twisting member 910 to prevent twisting member 910 from moving and unnecessarily unwinding strands 904(1-6) as a result of the weight of container 918 or any spreading force placed on the unwound portions of strands 904(1-6).

In the present embodiment, container 918 is a bowl supported by second ends 908(1-6) of strands 104(1-6). Container 918 is fashioned with a lip 926, which is adapted to lie over second ends 908(1-6) of strands 904(1-6). Bowl 918 can be used as a planter for containing flowers and/or other garden plants, or could be used to hold a holiday item, such as colored glass Christmas balls, candy canes, or other food items or festive objects. In an alternate embodiment, bowl 918 could simply rest in between strands 904(1-6) instead of being supported by lip 926. Further, more of strand material 902 can be unwound to provide, for example, a plant holder that holds a potted plant closer to the ground, and where strands 904(1-7) extend beyond the top of the planter to support climbing plants. In yet another embodiment, container 918 can be fashioned to simply clip to strands 904(1-6) near their second ends 908(1-6).

Although container 918 is shown to be a bowl in the present embodiment, there are many conceivable items that could be attached to decorative structure 900. For example, the garland of FIG. 1 could be attached to strands 904(1-6), or optionally a plant, bush, or sapling, such as climbing ivy in need of structural support. In another example, container 918 might be a tiki torch adapted to mount to strands 904(1-6). In yet another example, container 918 might also be fashioned to hang from one or more of strands 904(1-6). Indeed, there are many conceivable methods for supporting items with decorative structure 900.

There are also many alternate embodiments of anchoring member 920. Although anchoring member 920 is shown as a conical spike for pressing into ground 922, anchoring member 920 can be any device that retains decorative structure 900 in its desired position. For example, anchoring member 920 could be a bracket adapted for receiving cover 912 in order to anchor decorative structure 900 in a desired position (e.g., to the side of a building, to a deck, upside down on a ceiling, etc.). As another example, anchoring member 920 can be a weighted receptacle adapted to receive cover 912.

Decorative structure 900 provides many of the same advantages as Christmas tree 100. First, decorative structure can be quickly and easily erected and collapsed. Furthermore, in its wound state, decorative structure 900 can be easily transported and stored because, in its wound state, decorative structure 900 is not significantly larger than the strand steel cable from which it is formed (see FIG. 4). Still another advantage is that strands 904(1-6) retain their twisted shape when unwound thereby providing a wavy decorative appearance, in addition to functioning to support a container positioned between strands 904(1-6).

Also similar to tree 100, strands 904(1-7) can be individually coated for aesthetic appearance and protection. The inventor has determined that strands 904(1-7) (and the other components of decorative structure 900) can be easily powder coated or painted when strands 904(1-7) are unwound. Additionally, strands 904(1-7) can be powder coated or painted in a variety of colors depending on intended use and individual preference. In some particular applications, however, no coating whatsoever is necessary.

To summarize, from its erected state decorative structure 900 is collapsed as follows. First, container 918 is removed from the second ends 908(1-6) of strands 904(1-6). Then, strand material 902 is removed from anchoring member 920, and twisting member 910 can be advanced toward second ends 908(1-6) of strands 904(1-6) by rotating twisting member 910 about an axis passing longitudinally therethrough until twisting member 910 contacts at least one of twisting member retainers 916(1-6). Then, twisting member retainer 914 is positioned near twisting member 910 to retain strands 904(1-6) in a wound state. Finally, anchoring member 920 can be optionally removed from ground 922 by pulling up on press plate 923. If anchoring member 920 is permanently attached to cover 912, it will be removed when decorative structure 900 is pulled from ground 922.

From its wound state, decorative structure 900 is erected as follows. First, anchoring member 920 is pressed into ground 922 by pressing on press plate 923 and/or by pushing down with strand material 902. Next, twisting member retainer 914 is moved toward first ends 906(1-7) of strands 904(1-7), and strands 904(1-6) are thereby unwound. In the present embodiment, strands 904(1-6) are only partially unwound such that strands 904(1-6) retain their strength when erected and remain semi-rigid. Next, twisting member retainer 914 is positioned below twisting member 910 so that twisting member 910 does not unintentionally unwind strands 904(1-6) further. Finally, container 918 is positioned near the second ends 908(1-6) of strands 904(1-6). It should be noted that strands 904(1-6) can be unwound before or after decorative structure 900 is positioned in ground 922.

It is also an advantage of the present invention that decorative structures 100 and 900 can be embodied in a single structure. For example, if anchoring member 920 and decorative cap 120 are provided along with decorative structure 100, then the buyer can use the structure as both Christmas tree 100 and decorative/support structure 900 by simply interchanging decorative cap 120 and anchoring member 920.

The description of particular embodiments of the present invention is now complete. Many of the described features may be substituted, altered, or omitted without departing from the scope of the invention. For example, alternate anchoring members 920 (e.g., a weighted receptacle, bracket, etc.), may be substituted for the conically shaped embodiment shown. As another example, the decorative structure can be used to support many items besides bowl shaped containers (e.g., ivy, hanging decorations, etc.). These and other deviations from the particular embodiments shown will be apparent to those skilled in the art, particularly in view of the foregoing disclosure.

I claim:

1. A decorative structure, comprising:

a length of strand material, said strand material including a plurality of individual strands twisted with respect to one another, said strands being fixed with respect to one another near first ends of said strands;

a twisting member having a plurality of apertures formed therein, each of said apertures adapted to receive a respective one of said individual strands therethrough; and an anchoring member disposed near said first ends of said strands, said anchoring member adapted to anchor said decorative structure to a support surface; and wherein each of said strands is positioned through a respective one of said apertures, and whereby advancing said twisting member from second ends of said strands toward said first ends of said strands causes said strand material to unwind.

2. A decorative structure according to claim 1, wherein advancing said twisting member from said first ends of said strands toward said second ends of said strands causes said strand material to wind up.

3. A decorative structure according to claim 1, further including a coupling device disposed near said first ends of said strands, said coupling device adapted to fix said strands together with respect to one another.

4. A decorative structure according to claim 3, wherein said coupling device comprises a weld.

5. A decorative structure according to claim 1, wherein said anchoring member is adapted to fix said strands together with respect to one another near said first ends of said strands.

6. A decorative structure according to claim 1, wherein said strand material comprises strand steel.

7. A decorative structure according to claim 1, further including a cover for covering said first ends of said strands.

8. A decorative structure according to claim 7, wherein said anchoring member is adapted to mount to said cover.

9. A decorative structure according to claim 1, wherein said twisting member comprises a disc.

10. A decorative structure according to claim 9, wherein said disc includes at least one aperture for each said individual strand of said strand material.

11. A decorative structure according to claim 1, wherein at least one of said apertures formed in said twisting member is oblong in shape.

12. A decorative structure according to claim 1, further including a strand retainer for retaining said strands in a wound state.

13. A decorative structure according to claim 12, wherein said strand retainer comprises an annular ring, said annular ring having an inner diameter slightly larger than the diameter of said strand material when said strands are in said wound state.

14. A decorative structure according to claim 13, wherein said annular ring is disposed between said first ends of said strands and said twisting member, whereby moving said twisting member toward said first ends causes said annular ring to move toward said first ends of said strands.

15. A decorative structure according to claim 1, further comprising at least one twisting member retainer for retaining at least one of said strands in one of said apertures of said twisting member.

16. A decorative structure according to claim 1, wherein twisting said twisting member about a longitudinal axis of said strand material will cause said individual strands of said strand material to wind or unwind with respect to one another depending on the direction of rotation of said twisting member.

17. A decorative structure according to claim 1, wherein said strands are formed of a semi-rigid material such that said decorative structure is capable of supporting at least one container near second ends of said strands.

18. A decorative structure according to claim 1, wherein said anchoring member is conically shaped such that said anchoring member can be pressed into said support surface.

19. A decorative structure according to claim 18, wherein said decorative structure further includes a press plate for receiving pressure thereon to press said anchoring member into said support surface.

20. A decorative structure according to claim 1, wherein said decorative structure includes at least one container adapted to engage at least one of said individual strands.

21. A decorative structure according to claim 1, wherein said anchoring member supports second ends of said strands above said first ends of said stands.

22. A decorative structure comprising:

a length of strand material, said strand material including a plurality of individual strands twisted with respect to one another, said strands being fixed with respect to one another near first ends of said strands;

a twisting member having a plurality of apertures formed therein, each of said apertures adapted to receive a respective one of said individual strands therethrough; and an anchoring member disposed near said first ends of said strands, said anchoring member adapted to anchor said decorative structure to a support surface; and wherein said strand material comprises strand steel.

23. A decorative structure comprising:

a length of strand material, said strand material including a plurality of individual strands twisted with respect to one another, said strands being fixed with respect to one another near first ends of said strands;

a twisting member having a plurality of apertures formed therein, each of said apertures adapted to receive a respective one of said individual strands therethrough; and an anchoring member disposed near said first ends of said strands, said anchoring member adapted to anchor said decorative structure to a support surface; and a strand retainer for retaining said strands in a wound state.

24. A decorative structure according to claim 23, wherein said strand retainer comprises an annular ring, said annular ring having an inner diameter slightly larger than the diameter of said strand material when said strands are in said wound state.

25. A decorative structure according to claim 24, wherein said annular ring is disposed between said first ends of said strands and said twisting member, whereby moving said twisting member toward said first ends causes said annular ring to move toward said first ends of said strands.

26. A decorative structure comprising:

a length of strand material, said strand material including a plurality of individual strands twisted with respect to one another, said strands being fixed with respect to one another near first ends of said strands;

a twisting member having a plurality of apertures formed therein, each of said apertures adapted to receive a respective one of said individual strands therethrough;

an anchoring member disposed near said first ends of said strands, said anchoring member adapted to anchor said decorative structure to a support surface; and at least one twisting member retainer for retaining at least one of said strands in one of said apertures of said twisting member.

27. A decorative structure comprising:

a length of strand material, said strand material including a plurality of individual strands twisted with respect to one another, said strands being fixed with respect to one another near first ends of said strands;

a twisting member having plurality of apertures formed therein, each of said apertures adapted to receive a respective one of said individual strands therethrough, whereby twisting said twisting member about a longitudinal axis of said strand material will cause said individual strands of said strand material to wind or unwind with respect to one another depending on the direction of rotation of said twisting member; and an anchoring member disposed near said first ends of said strands, said anchoring member adapted to anchor said decorative structure to a support surface.

28. A decorative structure comprising:

a length of strand material, said strand material including a plurality of individual strands twisted with respect to one another, said strands being fixed with respect to one another near first ends of said strands;

a twisting member having a plurality of apertures formed therein, each of said apertures adapted to receive a respective one of said individual strands therethrough; and an anchoring member disposed near said first ends of said strands, said anchoring member adapted to anchor said decorative structure to a support surface; and wherein said anchoring member is conically shaped such that said anchoring member can be pressed into said support surface.

29. A decorative structure according to claim 28, wherein said decorative structure further includes a press plate for receiving pressure thereon to press said anchoring member into said support surface.

* * * * *